US005724846A

United States Patent [19]

Wang et al.

[11] Patent Number: 5,724,846

[45] Date of Patent: Mar. 10, 1998

[54] INTERRUPTION OF ROLLING MILL CHATTER BY INDUCED VIBRATIONS

[75] Inventors: Albert C. Wang, Murrysville; K. Wing Chang; L. Duane Dunlap, both of Pittsburgh; Jing Luo, Monroeville; D. Frederick Stewart, Export, all of Pa.; Michael L. Barry, Maryville; Terry C. Lee, Alcoa, both of Tenn.

[73] Assignee: Aluminum Company of America, Pittsburgh, Pa.

[21] Appl. No.: 594,542

[22] Filed: Jan. 31, 1996

[51] Int. Cl.[6] ..... B21B 31/00

[52] U.S. Cl. ..... 72/237; 72/10.8; 72/13.4

[58] Field of Search ..... 72/10.8, 10.9, 72/10.1, 10.7, 13.4, 13.5, 14.1, 31.07, 205, 237, 241.2, 241.4, 242.2, 245, 246, 247, 710; 248/550, 638; 73/593, 660; 464/180

[56] References Cited

U.S. PATENT DOCUMENTS

| | | | |
|---|---|---|---|
| 4,700,312 | 10/1987 | Kikuma et al. | 72/10.4 |
| 5,272,443 | 12/1993 | Winchip et al. | 72/31.01 |
| 5,515,731 | 5/1996 | Weisshaar et al. | 72/241.4 |

FOREIGN PATENT DOCUMENTS

| | | | |
|---|---|---|---|
| 60-238009 | 11/1985 | Japan | 72/247 |
| 62-220207 | 9/1987 | Japan | 72/10.1 |
| 63-101013 | 5/1988 | Japan | 72/12.3 |
| 2-133108 | 5/1990 | Japan | 72/247 |
| 0647416 | 2/1994 | Japan | 72/247 |
| 0248611 | 7/1969 | U.S.S.R. | 72/710 |
| 0362653 | 12/1972 | U.S.S.R. | 72/710 |
| 0570421 | 8/1977 | U.S.S.R. | 72/710 |
| 0617089 | 7/1978 | U.S.S.R. | 72/710 |
| 0686794 | 9/1979 | U.S.S.R. | 72/710 |

*Primary Examiner*—Lowell A. Larson

*Attorney, Agent, or Firm*—Elroy Strickland; Tracey D. Beiriger

[57] ABSTRACT

A method of preventing roll chatter in a stand of a rolling mill during the process of directing a strip of material through the mill. The method comprises the step of introducing into the stand a low power vibration component that prevents the rolls in the stand from vertically oscillating in any generally large, uncontrollable manner.

10 Claims, 2 Drawing Sheets

THIRD OCTAVE CHATTER

THIRD OCTAVE CHATTER

FIFTH OCTAVE CHATTER

FIFTH OCTAVE CHATTER

INTERRUPTION OF ROLLING MILL CHATTER BY INDUCED VIBRATIONS

BACKGROUND OF THE INVENTION

Figure 1A:
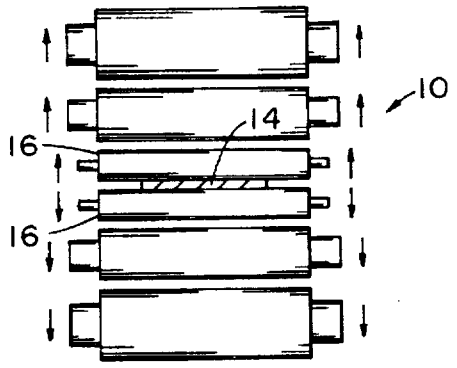

The present invention relates to rolling mills, and particularly to chatter in rolling mill stands.

All rolling mills have chatter problems. Mill stands have a plurality of rolls that include relatively small diameter work rolls that engage directly the strip of material being rolled, large diameter backup rolls, and any intermediate rolls that may be located between the backup and the work rolls in stands having more than four rolls (two work and two backups). Chatter is roll oscillation in a substantially vertical direction (with some horizontal motion) in generally large uncontrollable amplitudes of motion at a fundamental frequency. Chatter occurs in a mill stand when its frequency equals the natural frequency of the stand structure. Vertical oscillating motion of mill rolls quickly arrives at a synchronous condition. When this happens, the energy of the motion accumulates in the stand at about 3600 pounds per second, the rate of accumulation depending upon the travel speed of the strip and the mass of the rolls. In any case, in a relatively short period of time after chatter begins, a substantial vertical motion can take place in a roll stand unless the speed of the mill is reduced or other steps are taken to dampen the vertical motion of the rolls.

Roll chatter results in visual parallel marks being rolled into the surfaces of the strip crosswise of its robing direction and, if severe enough, in a cyclically varying gauge. Visual strip marks and varying gauge are quality problems which result in outright rejection of the strip by the customer of the strip producer. There are two major forms of chatter in high speed rolling mills, namely, the third and fifth octaves of motion. The third octave is a low frequency in the range of 100 to 200 hertz, whereas the fifth octave is a relatively high frequency in the range of 500 to 700 hertz. When these octave motions occur, the speed of the mill is required to be run as much as 30% less than its maximum production rate.

Mill rolls have bearings at the ends thereof located in chocks mounted in stand housings. The chocks vertically oscillate in the stand housing when chatter occurs. Heretofore, liners have been placed between the chock sides and vertical housing beams that support the chocks to prevent the chocks and their associated rolls from vertical movement. Such liners include inflatable devices that further tighten the chocks within the vertical beams to prevent roll oscillation. Liner systems can control only third octave chatter and are otherwise generally not reliable. In addition, the friction effected between the liner and the stand housing reduces the ability to control the gauge of the strip being rolled, as gauge control is effected through vertical displacement of the rolls relative to the strip using mechanical screws or hydraulic cylinders operating on the chocks.

SUMMARY OF THE INVENTION

The present invention is directed to stopping vertical and incidental horizontal vibrating motion of mill rolls (chatter) by introducing a source of low power vibration to the rolls that is non-synchronous with the frequency of the roll vibration. The non-synchronous frequency so introduced surprisingly stops chatter immediately and prevents its recurrence as long as the non-synchronous motion is applied. The low power motion is effective in this regard because it stops accumulation of oscillation energy in the stand, i.e., the energy builds quickly to significant magnitudes. In this manner, vertical motion never starts to any significant degree. The speed of the stand and of the mill in which multiple stands are employed can therefore remain at a high maximum production rate while the induced motion is of such a low magnitude that it does not adversely affect the rolling process.

The low power non-synchronous frequency can be supplied to a stand in a variety of ways. For example, the bearings at the ends of one roll in a stand can be provided with a predetermined looseness relative to the other roll bearings. This allows the "loose" roll to assume a mechanical motion and frequency that is not that of the remaining rolls having normal (tighter) bearing clearances and a larger combined mass, i.e., the loose roll assumes a motion that distorts the harmonic motions of the other rolls, which is at a frequency different from the oscillating frequency of the other rolls.

Another mechanism for introducing (inducing) such non-synchronous vibration to a stand is to provide a source of mechanical vibration external of the stand and then applying the vibration to roll chocks, roll bearings or tension bars (used to maintain appropriate tension on the strip between stands). This external vibration behaves in a manner similar to the loose bearings in that it acts to disrupt any building of the vertical oscillation before such building can start.

Another method involves a non-synchronous pulsating rhythm applied to a hydraulic fluid supplied to hydraulic components of the stand, such as hydraulic cylinders employed to control strip gauge and effect bending of the work rolls about the strip. Such vibrating fluid motions can again be quite small, requiring low horsepower drive systems which can also be operated at variable frequencies. In addition, such systems can be designed to provide random frequencies applied to stand bearings or hydraulics, or a consistent, harmonic frequency relative to the fundamental chatter frequency.

THE DRAWINGS

Figure 1B:
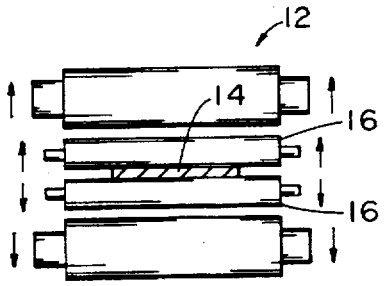
Figure 2A:
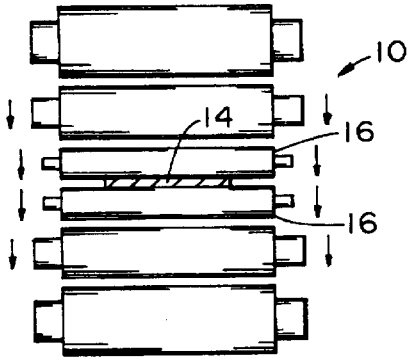
Figure 2B:
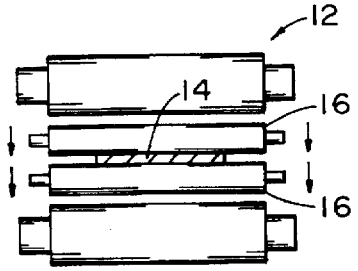
Figure 3A:
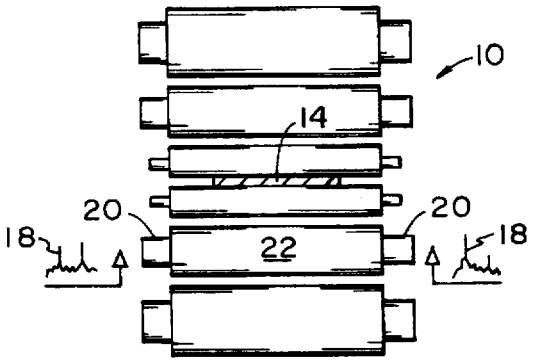
Figure 3B:
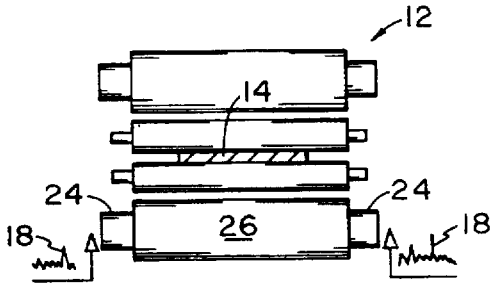
Figure 4:
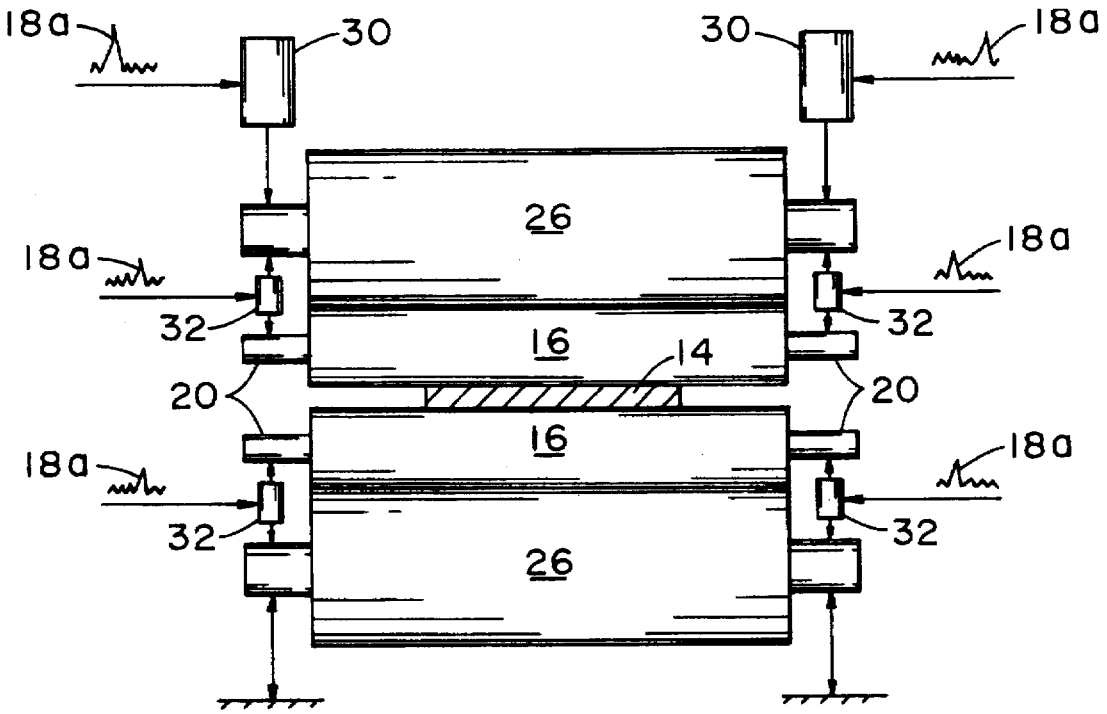

The invention, along with its objectives and advantages, will be better understood from consideration of the following detailed description and the accompanying drawings in which:

FIGS. 1*a* and 1*b* are diagrammatic representations of third octave chatter in a six-high and a four-high mill stand, FIGS. 2*a* and 2*b* are diagrammatic representations of fifth octave chatter in a six-high and a four-high mill stand, FIGS. 3*a* and 3*b* are schematic representations of a low power non-synchronous frequency motion introduced to a lower intermediate roll in a six-high stand and to a lower backup roll in a four-high stand, and FIG. 4 is a diagrammatic view of a rolling mill having hydraulic cylinders for controlling the rolling gap and roll bending functions in the mill.

PREFERRED EMBODIMENT

Referring now to FIGS. 1*a* and 1*b* of the drawings, third octave chatter phenomena (100 to 200 Hz range) in a six-high and in a four-high mill stand 10 and 12, respectively, are indicated by a plurality of arrows. Third octave chatter involves synchronous but opposed vertical motion between the upper and lower rolls of a roll stand, i.e., the three upper rolls in the six-high stand move (oscillate) together, while the three lower rolls move together. In a four-high stand, similar roll motion occurs with the two upper and lower rolls. A strip of material 14, passing between work rolls 16 of the stands at substantial tension (but less than the yield strength of the material) receives the chatter forces of the oscillating rolls and returns the energy of the oscillations to the upper and lower rolls in opposite directions at the third octave frequency.

In the case of fifth octave motion, as diagrammatically depicted in FIGS. 2*a* and 2*b*, strip 14 imparts vertical synchronous motions to intermediate rolls 22 located between backup rolls 26 and work rolls 16 in the same direction but not to the backup rolls. The rolls between the backup rolls 26 thus oscillate together, as evidenced by the arrows in FIGS. 2*a* and 2*b*.

As discussed earlier, the energy of the roll oscillations builds quickly over time such that the amplitude of roll motion can become substantial in short periods of time. Heretofore, one method of stopping the motion was by slowing the travel speed of strip 14 through the stands to avoid the third octave of the mill's natural frequency. This, of course, involves reducing the rotational speed of rolls and slows production of strip material. To avoid low production rates, liners were used to control roll motion, but these suffered from the problems discussed earlier.

Surprisingly, it has been found that the introduction of low power vibrating motion into a mill stand that is not synchronous with the high power (amplitude) oscillating frequency of roll chatter is effective to immediately stop the chatter at maximum operating (production) speeds. This procedure is shown schematically in FIGS. 3*a* and 3*b* of the drawings wherein a low power non-synchronous motion, as represented by waveforms 18, is introduced to the bearing chocks 20 of an intermediate roll 22 of a six-high stand 10 and to the chocks 24 of a backup roll 26 of a four-high stand 12. Any roll can be used for this purpose, i.e., the rolls receiving waveform motion 18 in FIGS. 3*a* and 3*b* are given by way of example only. A motion is thus induced into the bearings of rolls 22 and 26 that prevents the energy of roll oscillation from accumulating and thus prevents any significant roll motion in a primarily vertical direction, regardless of the operating speed of stand and mill.

Beating chocks 20 can be vibrated by a variety of means, such as a metal bar (not shown) inserted against a chock and mechanically vibrated by a suitable actuator such as a cylinder (not shown) connected to the bar at a location externally of the mill stand, the cylinder receiving a low power pulsating supply of fluid.

Waveforms 18 are depicted in FIGS. 3*a* and 3*b* as having both a variable amplitude (power) and a variable frequency. Either one (amplitude or frequency) can stop roll chatter, but both together are more effective than either one or the other.

Low power waveform motion 18 can be provided inherently in the bearings of mill rolls, as explained earlier by providing a certain looseness or tolerance in the bearings that allows a roll (or rolls) to oscillate at its own frequency. This frequency is different from the natural frequency of the remaining rolls (and roll masses) which interrupts the forming of third octave chatter.

Another means for stopping the accumulation of energy of roll oscillation is a low power vibrating motion introduced into the hydraulic fluids employed to operate stand cylinders 30 and/or 32 (FIG. 4) that control, respectively, the rolling gap of a stand (which sets the gauge for strip 14) and the bending of work rolls 16 about strip 14 to control its flatness. Either one or both hydraulic systems can be employed to introduce a low power, non-synchronous motion into a stand to stop large amplitude roll oscillation. This is accomplished by oscillating fluid pressure to the cylinders at a frequency that is not synchronous with the frequency of the roll chatter. The low power (magnitude) of the oscillating fluid pressure does not affect the overall operation of the cylinders in controlling the roll gap and roll bending. The introduction of such low power motion is indicated in FIG. 4 by numeral 18*a*. Again, only one set of cylinders 30 or 32 can be used to effect the elimination of roll chatter.

What is claimed is:

1. A method of preventing roll chatter in a rolling mill stand during the process of directing a strip of material through the stand, the stand having a natural frequency of vibration, the method comprising:

introducing into the mill a vibration frequency component that is non-synchronous with that of the stand to prevent mill rolls from vertically oscillating at a certain octaval frequency in any generally large, uncontrollable manner, the prevention of roll chatter at said frequency preventing surface marking of the strip.

2. The method of claim 1 in which the vibration component introduced into the stand is provided by a low power, variable frequency system, the method including:

applying the low power, variable frequency of said system to roll chock or roll bearing locations in the stand.

3. The method of claim 1 in which the stand has a rolling gap and hydraulic systems for respectively adjusting the rolling gap and for controlling the force at which backup rolls press against work rolls of the stand, the method including:

vibrating one or both of the hydraulic systems at a variable frequency.

4. The method of claim 1 in which the vibrating component is provided with a varying frequency.

5. The method of claim 1 in which the vibrating component is provided with a varying amplitude.

6. The method of claim 1 in which the vibrating component is provided with a varying frequency and a varying amplitude.

7. The method of claim 1 in which the vibration component introduced into the stand is provided by roll bearings having a predetermined design looseness that permits the mill rolls supported by the loose bearings to vibrate in a non-synchronous manner with other moving components in the stand.

8. The method of claim 1 wherein the octaval frequency of roll chatter is at third and fifth octaves, the frequency ranges of which are respectively 100 to 200 and 500 to 700 Hertz.

9. A method of controlling the vertical motions of a plurality of vertically disposed rolls in a rolling mill during the process of directing a strip of material through the mill, said vertical motions occurring at a natural frequency of the rolls, the method comprising:

introducing into the mill a vibration component having a frequency different from the natural frequency of the vertical motions of the rolls such that said vertical motions become non-synchronous with each other.

10. The method of claim 8 wherein the vertical motions of the rolls can take place at third and fifth octaves, the frequency ranges of which are respectively 100 to 200 and 500 to 700 Hertz.

* * * * *

UNITED STATES PATENT AND TRADEMARK OFFICE

CERTIFICATE OF CORRECTION

PATENT NO. : 5,724,846

DATED : March 10, 1998

INVENTOR(S) : Albert C. Wang et al.

It is certified that error appears in the above-identified patent and that said Letters Patent is hereby corrected as shown below:

Change "K. Wing Chang" to -- K. Wing Chan --.

Signed and Sealed this

Second Day of June, 1998

*Attest:*

*Attesting Officer*

BRUCE LEHMAN

*Commissioner of Patents and Trademarks*